US010060643B2

(12) United States Patent
Takeda et al.

(10) Patent No.: US 10,060,643 B2
(45) Date of Patent: Aug. 28, 2018

(54) AIR-CONDITIONING APPARATUS AND AIR-CONDITIONING SYSTEM EXECUTING A PRECOOLING OPERATION OR A PREHEATING OPERATION

(71) Applicant: Mitsubishi Electric Corporation, Tokyo (JP)

(72) Inventors: Emi Takeda, Tokyo (JP); Shinichi Ito, Tokyo (JP); Fumitake Unezaki, Tokyo (JP); Mamoru Hamada, Tokyo (JP); Toshiaki Yoshikawa, Tokyo (JP); Takashi Matsumoto, Tokyo (JP); Hirotoshi Yano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 878 days.

(21) Appl. No.: 14/400,437

(22) PCT Filed: May 13, 2013

(86) PCT No.: PCT/JP2013/063238
§ 371 (c)(1),
(2) Date: Nov. 11, 2014

(87) PCT Pub. No.: WO2013/172279
PCT Pub. Date: Nov. 21, 2013

(65) Prior Publication Data

US 2015/0136379 A1 May 21, 2015

(30) Foreign Application Priority Data

May 14, 2012 (JP) ..... 2012-110232
Oct. 16, 2012 (JP) ..... 2012-228707

(51) Int. Cl.
*F24F 11/00* (2018.01)
*F24D 19/10* (2006.01)
(Continued)

(52) U.S. Cl.
CPC ..... *F24F 11/0012* (2013.01); *F24D 19/1084* (2013.01); *F24F 11/30* (2018.01);
(Continued)

(58) Field of Classification Search
CPC ..... F24F 11/0012; F24F 2011/0075
See application file for complete search history.

(56) References Cited

U.S. PATENT DOCUMENTS 4,674,027 A * 6/1987 Beckey ..... G05D 23/1904 165/238
4,702,305 A * 10/1987 Beckey ..... F24D 19/1039 165/239
(Continued)

FOREIGN PATENT DOCUMENTS

CN 102089593 A 6/2011
EP 2320152 A1 5/2011
(Continued)

OTHER PUBLICATIONS

Extended European Search Report dated Mar. 4, 2016 in the corresponding EP application No. 13790663.2.
(Continued)

*Primary Examiner* — Frantz Jules
*Assistant Examiner* — Nelson Nieves
(74) *Attorney, Agent, or Firm* — Posz Law Group, PLC

(57) ABSTRACT

In an air-conditioning system, during precooling or preheating control, a setting temperature is controlled such that a first temperature difference between the setting temperature and an indoor temperature is not less than a temperature difference at which a compressor performs operation, and the setting temperature is controlled to be changed to a target temperature when a second temperature difference between the indoor temperature and the target temperature is less than the first temperature difference. Since the compressor can be
(Continued)

operated in the range from a low capacity to a medium capacity, operation efficiency of the air-conditioning apparatus can be increased, and the energy-saving operation with less power consumption can be realized. Since the operation capacity of the compressor can be readily suppressed with adjustment of the setting temperature, control is facilitated and the precooling control can be incorporated in various types of air-conditioning apparatuses.

20 Claims, 4 Drawing Sheets

(51) Int. Cl.

| | |
|---|---|
| ***F24F 11/30*** | (2018.01) |
| ***F24F 11/62*** | (2018.01) |
| ***F24F 11/70*** | (2018.01) |
| *F24F 110/10* | (2018.01) |
| *F24F 110/12* | (2018.01) |
| *F24F 120/10* | (2018.01) |
| *F24F 140/60* | (2018.01) |
| *F24F 11/64* | (2018.01) |
| *F24F 11/65* | (2018.01) |
| *F24F 11/61* | (2018.01) |
| *F24F 11/46* | (2018.01) |

(52) U.S. Cl.
CPC ..... *F24F 11/62* (2018.01); *F24F 11/70* (2018.01); *F24D 19/1093* (2013.01); *F24D 2200/02* (2013.01); *F24D 2200/12* (2013.01); *F24F 11/46* (2018.01); *F24F 11/61* (2018.01); *F24F 11/64* (2018.01); *F24F 11/65* (2018.01); *F24F 2110/10* (2018.01); *F24F 2110/12* (2018.01); *F24F 2120/10* (2018.01); *F24F 2140/60* (2018.01)

(56) References Cited

U.S. PATENT DOCUMENTS 4,702,413 A * 10/1987 Beckey ..... G05D 23/1904 165/240
4,753,388 A * 6/1988 Rummage ..... F23N 5/203 236/46 R
4,989,414 A * 2/1991 Murayama ..... F24F 11/00 62/196.3
5,197,293 A * 3/1993 Okamura ..... F24F 11/0009 165/263
5,261,481 A * 11/1993 Baldwin ..... F24F 11/00 165/11.1
5,309,730 A * 5/1994 Strand ..... F02D 29/04 62/228.4
5,314,004 A * 5/1994 Strand ..... F24F 11/00 165/238
5,699,674 A * 12/1997 Lee ..... G05D 23/1951 62/115
5,720,176 A * 2/1998 Manson ..... F24F 11/0009 165/238
5,822,997 A * 10/1998 Atterbury ..... F25B 13/00 165/239
6,070,110 A * 5/2000 Shah ..... F24F 11/0008 165/205
8,090,477 B1 * 1/2012 Steinberg ..... G05D 23/1923 700/276
8,556,188 B2 * 10/2013 Steinberg ..... F24F 11/0034 165/237
2010/0262299 A1 * 10/2010 Cheung ..... G05B 13/0245 700/278
2011/0107781 A1 * 5/2011 Kinugasa ..... F24F 11/008 62/157
2011/0238222 A1 * 9/2011 Nikovski ..... F24F 11/006 700/276
2012/0016526 A1 * 1/2012 Burton ..... F24F 11/0012 700/278
2012/0053745 A1 * 3/2012 Ng ..... F24F 11/00 700/295
2012/0072030 A1 * 3/2012 Elliott ..... F24F 11/0009 700/276
2012/0091804 A1 * 4/2012 Altonen ..... E06B 9/68 307/31
2012/0185101 A1 * 7/2012 Leen ..... F24F 11/006 700/278
2015/0323943 A1 * 11/2015 Chan ..... G05D 23/1951 700/278

FOREIGN PATENT DOCUMENTS

| | | | |
|---|---|---|---|
| JP | 58-102043 | A | 6/1983 |
| JP | 60-142136 | A | 7/1985 |
| JP | 62-009137 | A | 1/1987 |
| JP | 63-029136 | A | 2/1988 |
| JP | 63-161338 | A | 7/1988 |
| JP | 63-302236 | A | 12/1988 |
| JP | 64-023049 | A | 1/1989 |
| JP | 02-178552 | A | 7/1990 |
| JP | 08-210690 | A | 8/1996 |
| JP | 2010-019515 | A | 1/2010 |
| JP | 2013-036678 | A | 2/2013 |

OTHER PUBLICATIONS

Office Action dated Apr. 19, 2016 issued in corresponding JP patent application No. 2014-515603 (and English translation).
Office Action dated Jun. 24, 2016 issued in corresponding CN patent application No. 201380025182.1 (and English translation).
Office Action dated Jan. 6, 2017 issued in corresponding CN patent application No. 201380025182.1 (and English translation).
International Search Report of the International Searching Authority dated Aug. 13, 2013 for the corresponding international application No. PCT/JP2013/063238 (and English translation).
Office Action dated Jul. 11, 2017 issued in corresponding CN patent application No. 201380025182.1 (and English translation).
Office Action dated Sep. 29, 2015 in the corresponding JP application No. 2014-515603 (with English translation).

* cited by examiner

AIR-CONDITIONING APPARATUS AND AIR-CONDITIONING SYSTEM EXECUTING A PRECOOLING OPERATION OR A PREHEATING OPERATION

CROSS REFERENCE TO RELATED APPLICATIONS

This application is a U.S. national stage application of PCT/JP2013/063238 filed on May 13, 2013, and is based on Japanese Patent Applications No. 2012-110232 filed on May 14, 2012 and No. 2012-228707 filed on Oct. 16, 2012, the contents of which are incorporated herein by reference.

TECHNICAL FIELD

The present invention relates to an air-conditioning system, and more particularly to control that enables precooling and preheating operations to be applied to various types of apparatuses.

BACKGROUND

Hitherto, preliminary operations (precooling and preheating) have been proposed to start up an air-conditioning apparatus air-conditioning apparatus prior to a designated time such that an indoor temperature reaches a target temperature at the designated time. In such a proposal, a preliminary operation time and a rotation speed of a compressor are calculated and set depending on the temperature of outside air (see, for example, Patent Literature 1).

Furthermore, with growing awareness of power saving, attention has recently be focused on a smart house in which home electrical appliances are monitored and controlled by a HEMS (Home Energy Management System) to utilize energy with high efficiency. In the case of cooking, for example, an air-conditioning apparatus is previously operated to precool or preheat a room prior to using an IH (Induction Heating) cooking heater or an range grill. As a result, peak power can be suppressed, and power consumption can be leveled.

PATENT LITERATURE

Patent Literature 1: Japanese Unexamined Patent Application Publication No. 63-161338

The control method disclosed in Patent Literature 1 has the following problems. A coefficient for use in calculating the rotation speed of the compressor is determined depending on the type of air-conditioning apparatus, and the control method is not versatile. When the air-conditioning apparatus is operated to perform precooling and preheating in the HEMS, it is difficult to change a frequency of the compressor in the air-conditioning apparatus from an external controller. Accordingly, the preliminary operation cannot be applied to existing air-conditioning apparatuses.

SUMMARY

The present invention has been accomplished in view of the above-described situations, and an object of the present invention is to provide an air-conditioning system with the function of precooling and preheating control, which can be applied to various types of air-conditioning apparatuses, to thereby realize cutting of power consumption and an improvement of comfortableness.

To achieve the above object, in the air-conditioning system according to the present invention, during precooling or preheating control, a setting temperature is controlled such that a first temperature difference between the setting temperature and an indoor temperature is not less than a temperature difference at which a compressor performs operation, and the setting temperature is controlled to be changed to a target temperature when a second temperature difference between the indoor temperature and the target temperature is less than the first temperature difference.

With the present invention, since the compressor can be operated in the range from a low capacity to a medium capacity, operation efficiency of the air-conditioning apparatus can be increased, and the energy-saving operation with less power consumption can be realized. Since the operation capacity of the compressor can be readily suppressed with adjustment of the setting temperature, control is facilitated and the precooling control can be incorporated in various types of air-conditioning apparatuses. Moreover, the precooling control can be executed from an external controller and can be employed in the HEMS and so on.

DETAILED DESCRIPTION

Embodiment 1.

Embodiments of the present invention will be described below with reference to the drawings.

Figure 1:
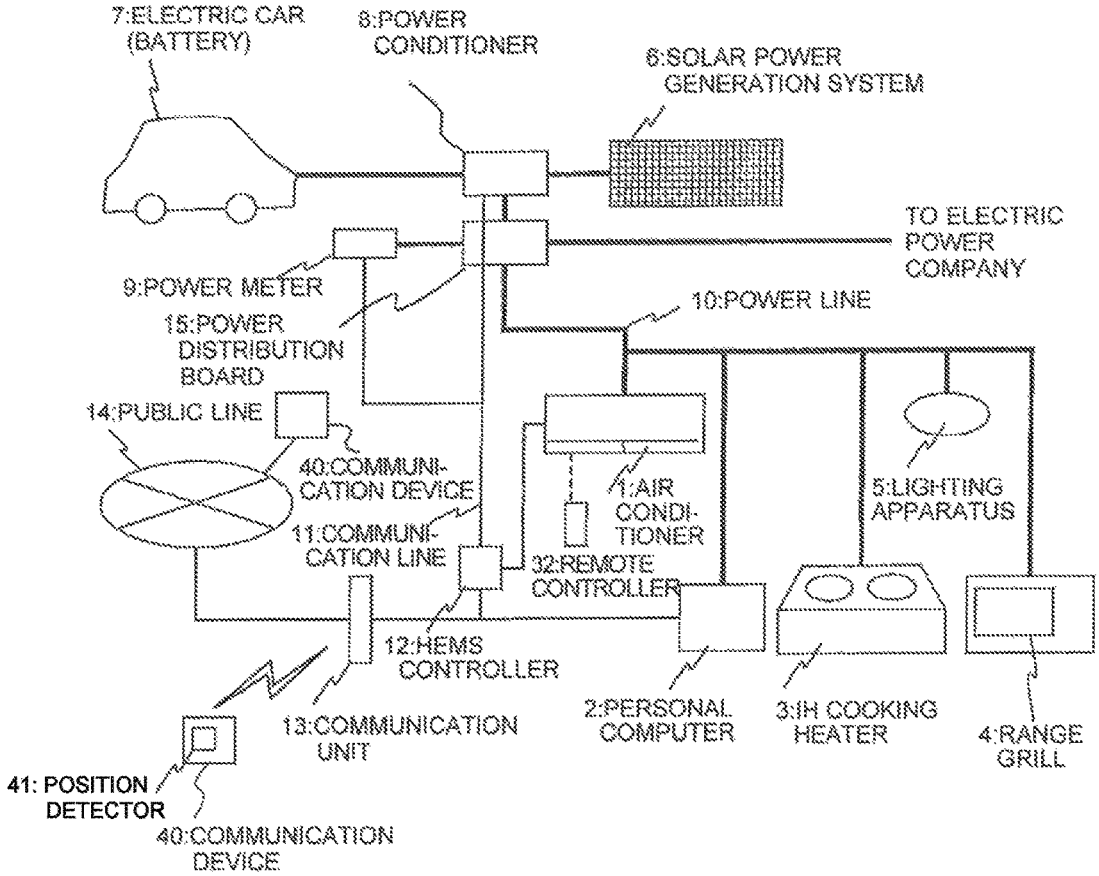
FIG. 1 is a block diagram illustrating, in a simplified form, the configuration of a HEMS according to an embodiment of the present invention.

FIG. 1 is a block diagram illustrating, in a simplified form, the configuration of a HEMS according to an embodiment of the present invention.

It is to be noted that in the drawings referred to below, including FIG. 1, relative relation among the sizes of individual components are different from actual one in some cases. In the drawings referred to below, components denoted by the same reference symbols are the same or equivalent components. This is applied in common to the entire text of this Description. Furthermore, forms of components described throughout the text of this Description are merely illustrative and the components are not limited to the described forms.

[Configuration of HEMS]

The configuration and the operation of the HEMS are described with reference to FIG. 1. Home electrical appliances, such as an air-conditioning apparatus 1, a personal computer 2, an IH cooking heater 3, an range grill 4, and a lighting apparatus 5, are equipped in a house (indoor). A solar power generation system 6 and an electric car (battery) 7 are equipped outdoor. The house is further equipped with a power conditioner 8, a power distribution panel 15, and a power meter 9. The above-mentioned appliances and devices are each connected to a power line 10. The home electrical appliances 1 to 5 are supplied with electricity from an electric power company, or with electricity from the solar power generation system 6 or the electric car (battery) 7. Power consumption can be measured by the power meter 9.

The home electrical appliances 1 to 5 are connected to a HEMS controller 12 through a communication line 11 such that the HEMS controller 12 can obtain operation information and issue control commands. With respect to the air-conditioning apparatus 1, for example, the HEMS controller 12 can send commands instructing startup and stop of the operation, change of the operation mode, such as cooling, heating, air-sending or dehumidifying, and remote control operations of changing a setting temperature, an air volume, an air direction, etc. The power conditioner 8 and the power meter 9 are also connected to the HEMS controller 12 through the communication line 11 such that the HEMS controller 12 can obtain power information. Furthermore, the HEMS controller 12 is connected to a public line 14 through a communication unit 13 to be able to transmit and receive data to and from the outside. The communication described above may be either wired or wireless communication.

Figure 2:
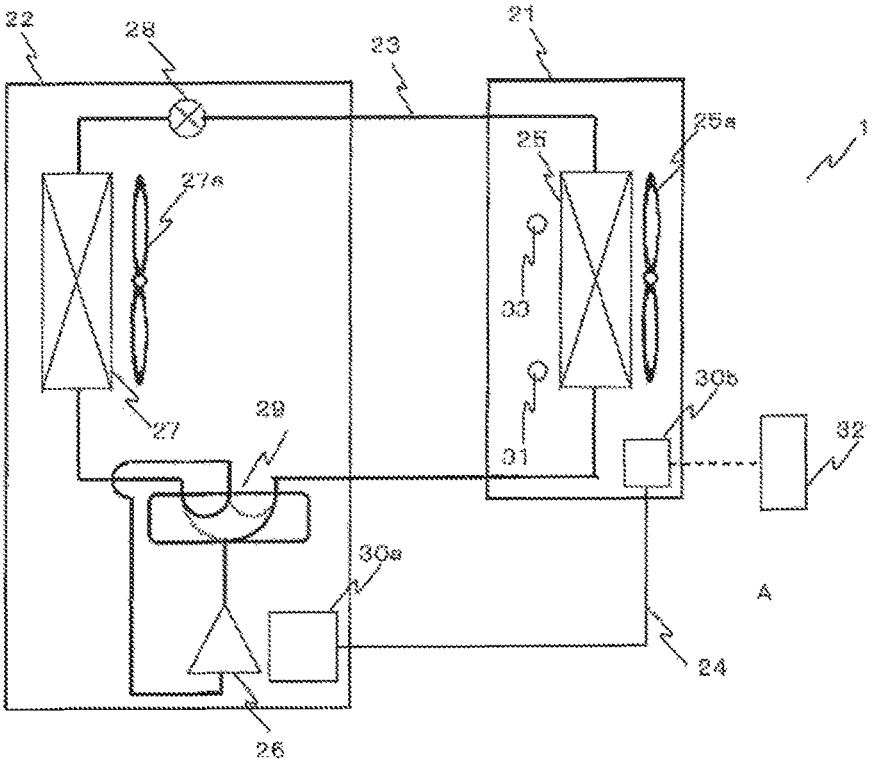
FIG. 2 is a schematic view illustrating, in a simplified form, the configuration of an air-conditioning apparatus according to the embodiment of the present invention.
Figure 2:
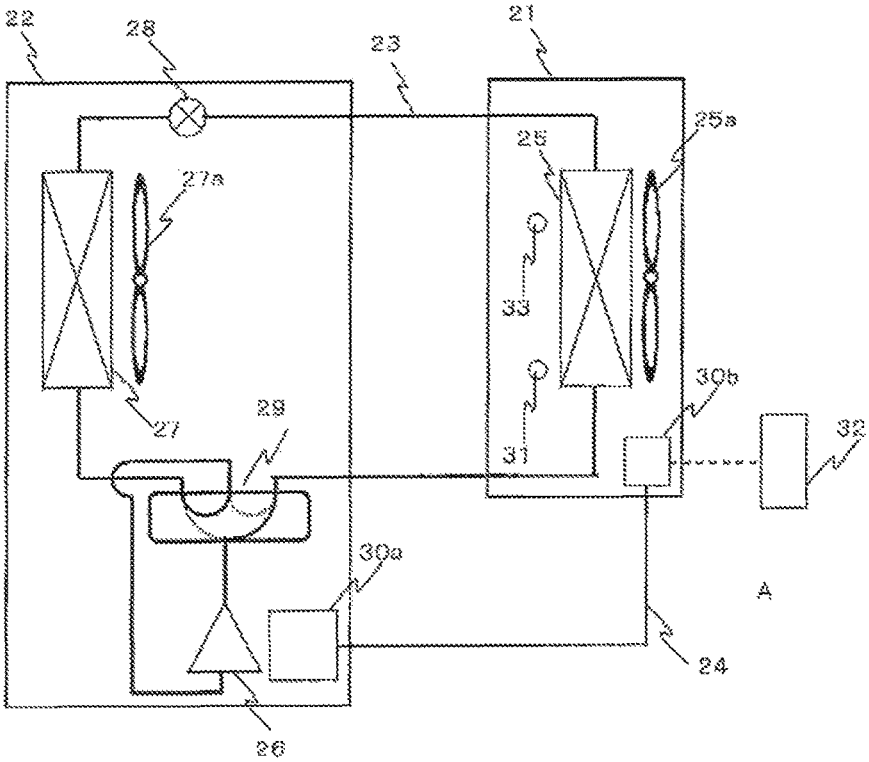

FIG. 2 is a schematic view illustrating, in a simplified form, the configuration of the air-conditioning apparatus 1 according to the embodiment of the present invention. The configuration and the control operation of the air-conditioning apparatus 1 will be described below with reference to FIG. 2. FIG. 2 illustrates not only the configuration of the air-conditioning apparatus 1, but also an exemplary layout of the air-conditioning apparatus 1.

[Configuration of Air Conditioner 1]

As illustrated in FIG. 2, the air-conditioning apparatus 1 performs air-conditioning in an indoor space A. Thus, an indoor unit 21 constituting the air-conditioning apparatus 1 is installed at such a place (e.g., on a wall of the indoor space A) that the indoor unit 21 can supply air-conditioned air to the indoor space A. The air-conditioning apparatus 1 is constituted by the indoor unit 21 and an outdoor unit 22. The indoor space A is cooled and heated with cold air and warm air sent from the indoor unit 21. The air-conditioning apparatus 1 incorporates a refrigeration cycle of vapor compression type. The indoor unit 21 and the outdoor unit 22 are connected to each other by coolant pipes 23 through which a coolant flows and via a communication line 24 through which communication is performed.

The indoor unit 21 includes an indoor heat exchanger 25. The outdoor unit 22 includes a compressor 26, an outdoor heat exchanger 27, an expansion valve 28, and a four-way valve 29. The refrigeration cycle is constituted by interconnecting those components in a looped fashion by the coolant pipes 23. The indoor unit 21 includes an indoor fan 25*a* that sucks air in the indoor space A and that blasts out the sucked air into the indoor space A after causing the sucked air to pass through the indoor heat exchanger 25. The outdoor unit 22 includes an outdoor fan 27*a* that sucks air in an outdoor space and that blasts out the sucked air into the outdoor space after causing the sucked air to pass through the outdoor heat exchanger 27.

The indoor heat exchanger 25 exchanges heat between cooling/heating energy supplied from the coolant flowing through the refrigeration cycle and indoor air. The indoor air having been subjected to the heat exchange in the indoor heat exchanger 25 is supplied as the air-conditioned air to the indoor space A, thereby cooling and heating the indoor space A. As described above, the indoor air is supplied to the indoor heat exchanger 25 by the indoor fan 25*a*.

The compressor 26 compresses the coolant into a state under high temperature and high pressure. The compressor 26 is driven by an inverter such that the operation capacity of the compressor 26 can be controlled depending on air-conditioning situations. The outdoor heat exchanger 27 exchanges heat between cooling/heating energy supplied from the coolant flowing through the refrigeration cycle and outdoor air. As described above, the outdoor air is supplied to the outdoor heat exchanger 27 by the outdoor fan 27*a*. The expansion valve 28 is connected between the indoor heat exchanger 25 and the outdoor heat exchanger 27, and it expands the coolant by reducing pressure. The expansion valve 28 is constituted as a valve that is able to variably control an opening degree, for example, as an electronic expansion valve. The four-way valve 29 is connected to the discharge side of the compressor 26, and it changes over a flow of the coolant depending on the operation (cooling operation or heating operation) of the air-conditioning apparatus 1.

The air-conditioning apparatus 1 further includes a measurement control device 30 (i.e., a measurement control device 30*a* for the outdoor unit and a measurement control device 30*b* for the indoor unit), which executes control of the air-conditioning apparatus 1. The indoor unit 21 includes an indoor temperature sensor 31 that measures the temperature in the indoor space A and a structural-member temperature detector 33 that detects a temperature of a structural member present indoors. Information measured by the indoor temperature sensor 31 and the structural-member temperature detector 33 is input to the measurement control device 30 through the communication line 24. The communication line 24 may be a wired or wireless line.

In accordance with a control program installed in advance, the measurement control device 30 commands the operation of the air-conditioning apparatus 1 based on information from the indoor temperature sensor 31 and other various sensors (not illustrated) included in the air-conditioning apparatus 1, operation information, and setting information set by a user. The measurement control device 30 is constituted by a microcomputer, for example, which can control the entirety of the air-conditioning apparatus 1 in a centralized manner. More specifically, the measurement control device 30 commands the operation of the air-conditioning apparatus 1 by controlling changeover of the four-way valve 29, the opening degree of the expansion valve 28, the driving frequency of the compressor 26, the rotation speed of the indoor fan 25*a*, the rotation speed of the outdoor fan 27*a*, and so on.

The indoor temperature sensor 31 is disposed in the indoor unit 21 and measures the temperature of the indoor air sucked into the indoor unit 21. Other various sensors disposed in the air-conditioning apparatus 1 include, for example, a pressure sensor that measures the pressure of the coolant discharged from the compressor 26, a pressure sensor that measures the pressure of the coolant sucked into the compressor 26, a temperature sensor that measures the temperature of the coolant discharged from the compressor 26, a temperature sensor that measures the temperature of the coolant sucked into the compressor 26, and a temperature sensor that measures the temperature of the outdoor air.

[Control Operation of Air Conditioner 1]

The control operation of the air-conditioning apparatus 1 will be described below. The ordinary operation of the air-conditioning apparatus 1 is first described. The air-conditioning apparatus 1 starts up the operation in accordance with an operation start command from a user of the air-conditioning apparatus 1. The user issues the operation start command to the air-conditioning apparatus 1 by manipulating the remote controller 32, for example. The operation start command contains an operation mode, such as a cooling operation or a heating operation. Thus, at the same time as when the air-conditioning apparatus 1 receives the operation start command, the operation mode is also set in the air-conditioning apparatus 1. The air-conditioning apparatus 1 performs the operation to hold a measured value of the indoor temperature sensor 31, which senses a representative temperature in the indoor space A as the indoor temperature, at a setting value set by the user. On that occasion, the operation is performed such that the indoor temperature is stably held near the setting value.

[Cooling Operation]

The cooling operation of the refrigeration cycle is described here. The coolant discharged from the compressor 26 passes through the four-way valve 29 and flows into the outdoor heat exchanger 27. The coolant having flowed into the outdoor heat exchanger 27 is condensed and liquefied through heat exchange with air, and then flows into the expansion valve 28. After being subjected to pressure reduction in the expansion valve 28, the coolant flows into the indoor heat exchanger 25. The coolant having flowed into the indoor heat exchanger 25 is evaporated through heat exchange with air, and is then sucked into the compressor 26 again after passing through the four-way valve 29. With the coolant flowing as described above, the indoor air is cooled by the indoor heat exchanger 25. An amount of heat exchange between the coolant and air in the indoor heat exchanger 25 is called cooling capacity. The cooling capacity is adjusted, for example, by changing the frequency of the compressor 26.

[Heating Operation]

The heating operation of the refrigeration cycle is described here. The coolant discharged from the compressor 26 passes through the four-way valve 29 and flows into the indoor heat exchanger 25. The coolant having flowed into the indoor heat exchanger 25 is condensed and liquefied through heat exchange with air, and then flows into the expansion valve 28. After being subjected to pressure reduction in the expansion valve 28, the coolant flows into the outdoor heat exchanger 27. The coolant having flowed into the outdoor heat exchanger 27 is evaporated through heat exchange with air, and is then sucked into the compressor 26 again after passing through the four-way valve 29. With the coolant flowing as described above, the indoor air is heated by the indoor heat exchanger 25. An amount of heat exchange between the coolant and air in the indoor heat exchanger 25 is called heating capacity. The heating capacity is adjusted, for example, by changing the frequency of the compressor 26.

When a temperature difference between the indoor temperature and the setting value is large, the air-conditioning apparatus 1 performs the operation in such a manner that the indoor temperature is settled more early to the setting value by increasing the capacity of the compressor 26 and increasing the heating capacity or the cooling capacity of the air-conditioning apparatus 1. When the temperature difference between the indoor temperature and the setting value is small, the air-conditioning apparatus 1 performs the operation in such a manner that the indoor space A is avoided from being heated or cooled excessively by reducing the capacity of the compressor 26 and reducing the heating capacity or the cooling capacity of the air-conditioning apparatus 1. Thus, the air-conditioning apparatus 1 performs the operation in a manner of stabilizing the indoor temperature.

The operation capacity of the compressor 26 is preferably set, for example, to be increased in proportion to the temperature difference. In that case, assuming the maximum capacity of the compressor 26 to be 100%, the compressor 26 is controlled to operate with the operation capacity of 40% at the temperature difference of 1 degree C., with the operation capacity of 70% at the temperature difference of 2 degrees C., and with the operation capacity of 100% at the temperature difference of 3 degrees C. or more. When the indoor temperature reaches the setting temperature, the air-conditioning apparatus 1 stops the operation of the compressor 26, and when the temperature difference between the indoor temperature and the setting temperature becomes a predetermined temperature (e.g., 1 degree C.) or more, the air-conditioning apparatus 1 starts up the operation of the compressor 26 again. In general, operation efficiency of the air-conditioning apparatus 1 increases as the operation capacity of the compressor 26 reduces.

[Control Flow]

Figure 3:
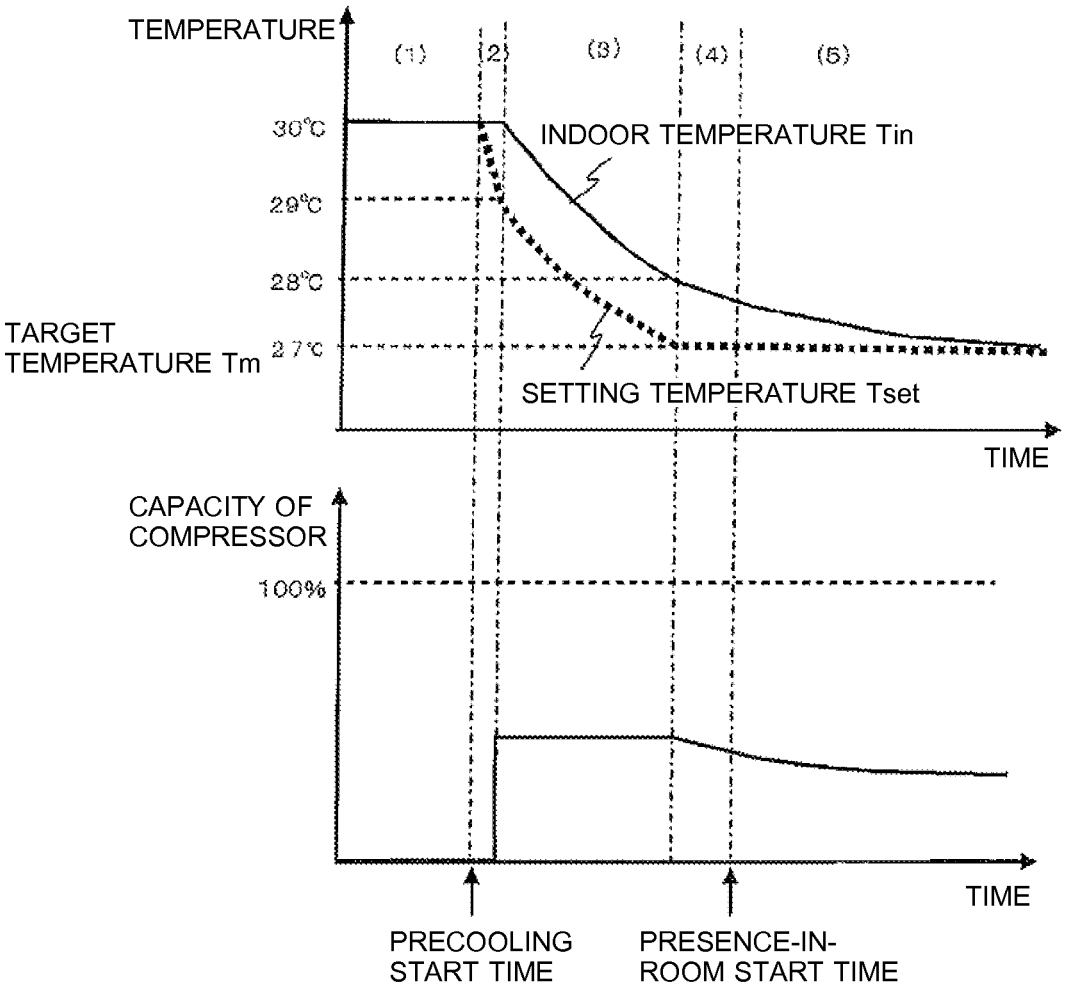
FIG. 3 is a graph depicting change of an indoor temperature due to operation of the air-conditioning apparatus and the operation capacity of a compressor with the lapse of time when a precooling operation of the air-conditioning apparatus according to the embodiment of the present invention is performed.
Figure 4:
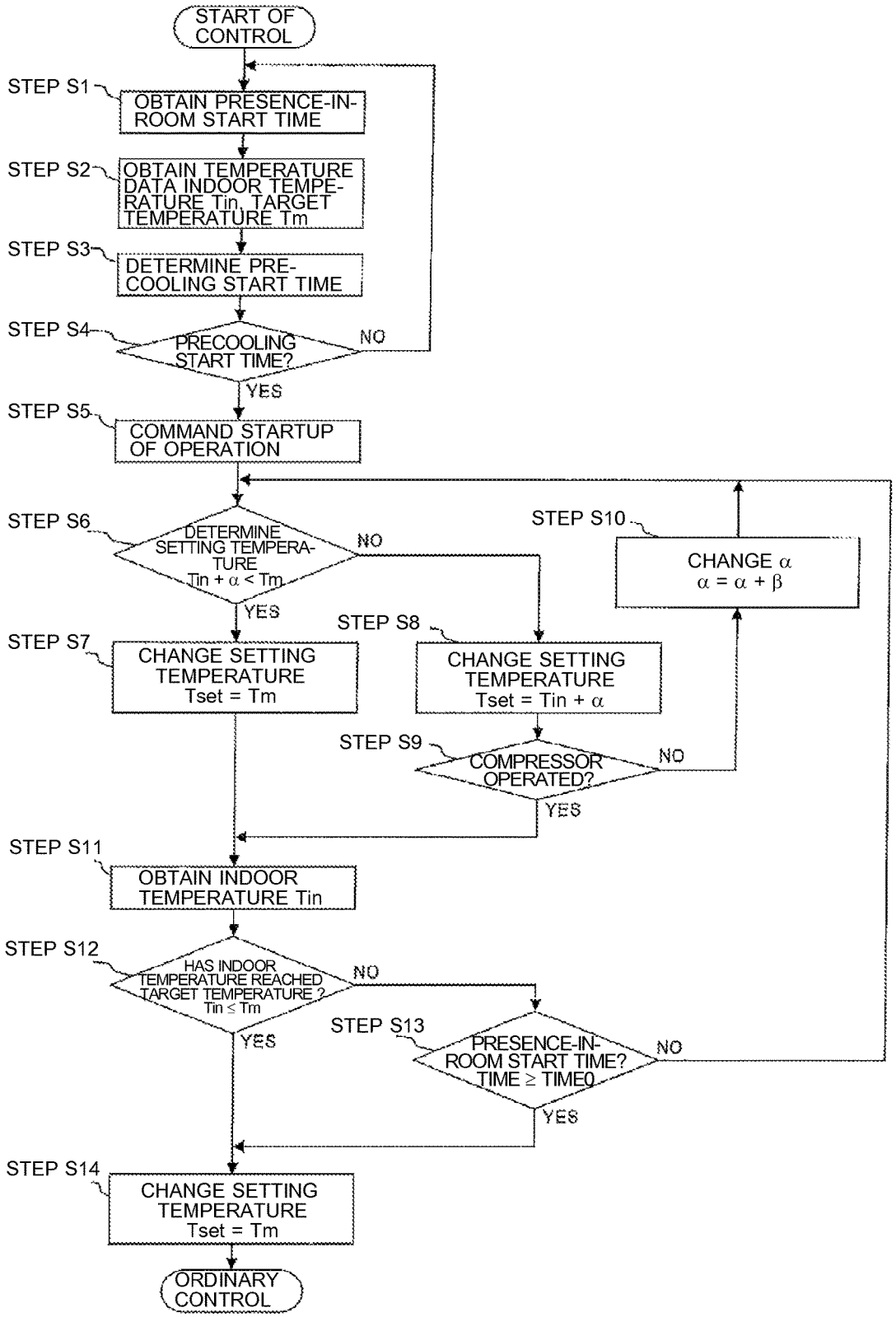
FIG. 4 is a flowchart depicting a flow of control process when the precooling operation of the air-conditioning apparatus according to the embodiment of the present invention is performed.

FIG. 3 illustrates examples of an indoor temperature Tin and a setting temperature Tset in the precooling operation, and FIG. 4 illustrates a flowchart of precooling control. Information processing for the precooling control may be executed in any of the measurement control device 30*a* for the outdoor unit, the measurement control device 30*b* for the indoor unit, the remote controller 32, the HEMS controller 12, and the personal computer 2.

FIG. 3 is divided into zones (1) to (5), which are described one by one below with reference to the flowchart of FIG. 4 as well.

((1) in FIG. 3)

First, a presence-in-room start time is obtained (step S1). Then, the indoor temperature Tin, a target temperature Tm when the user is present in the room, and so on are obtained (step S2). From the information thus obtained, a precooling start time is determined (step S3). If the current time does not yet pass the precooling start time (step 4; NO), the processing is returned to step S1. The acquisition of the presence-in-room start time (step S1) and the determination of the precooling start time (step S3) will be described in detail later.

((2) in FIG. 3)

If the current time reaches the precooling/preheating start time (step 4; YES), the operation of the air-conditioning apparatus is started (step S5). Before the setting temperature is changed to Tin+α, it is determined whether a value of Tin+α is lower than the target temperature Tm (step S6). That determination is to prevent excessive cooling during the precooling. In the case where the indoor temperature Tin is 30 degrees C., α is 0 degrees C., and the target temperature Tm is 27 degrees C., for example, because Tin+α is 30 degrees C. and is higher than the target temperature Tm of 27 degrees C. (step S6; NO), the setting temperature is changed to 30 degrees C. (step S8). While the compressor generally starts the operation in the cooling mode if the setting temperature Tset is not higher than the indoor temperature Tin, control specifications are different depending on the types of air-conditioning apparatuses. In consideration of the above point, whether the compressor is operated or not is determined (step S9). If the compressor is not operated (step S9; NO), α is changed until the compressor is operated (step 10). Assuming β to be −0.5 degrees C., for example, α is −0.5 degrees C. Thus, the setting temperature Tset is lowered from 30.0 degrees C. to 29.5 degrees C. It is then determined again whether the compressor is operated.

If the compressor is not operated, α is now changed to −1.0 degree C., and the setting temperature is lowered to 29.0 degrees C. It is then determined again whether the compressor is operated. Here, it is assumed that the compressor is operated at α being −1.0 degree C.

((3) in FIG. 3)

If the operation of the compressor is confirmed (step S9; YES), the indoor temperature Tin is obtained (step 11). If the indoor temperature Tin does not reach the target temperature Tm (step 12; NO), or if the current time does not yet pass the presence-in-room start time (step S13; NO), the processing is returned to step S6 in which the change of the setting temperature (step S8) is repeated. Here, the setting temperature Tset is maintained at Tin−1.0 degree C. due to lowering of the indoor temperature Tin.

(Method for Determining Operation and Stop of Compressor)

In determining whether the compressor is operated (step S9 in FIG. 4), the determination may be made directly by employing operation/stop information or a frequency value of the compressor when the determination is executed by the measurement control device 30*a* for the outdoor unit or the measurement control device 30*b* for the indoor unit. Alternatively, when the determination is executed by an external terminal, such as the HEMS controller 12, a value of power consumption of the air-conditioning apparatus 1 may be detected to determine that the compressor is operated if the value of the power consumption is larger than a predetermined value, and to determine that the compressor is stopped if the value of the power consumption is not larger than the predetermined value. The above-mentioned determination can be made based on the value of the power consumption because the compressor 26 occupies about 80 to 90% of total power consumption of the air-conditioning apparatus 1.

(Advantageous Effects)

By detecting the power consumption of the compressor and determining whether the air-conditioning apparatus is operated or stopped, the determination can be made regardless of maker of the air-conditioning apparatus, and the precooling control or the preheating control can be widely applied with higher universality.

((4) in FIG. 3)

If the value of Tin+α becomes lower than the target temperature Tm (step S6; YES), the setting temperature Tset is changed to the target temperature Tm (step S7). Then, the indoor temperature Tin is obtained (step S11). If the indoor temperature Tin does not reach the target temperature Tm (step S12; NO), or if the current time does not yet pass the presence-in-room start time (step S13; NO), the processing is returned to step S6 in which the above-described processing is repeated. In the example of FIG. 3, α is −1 degree C. Therefore, when the indoor temperature Tin becomes 28 degrees C., the setting temperature Tset is 27 degrees C. that is equal to the target temperature Tm. After that time, the setting temperature Tset is set to 27 degrees C. even when the indoor temperature Tin is lowered from 28 degrees C. As a result, excessive cooling during the precooling can be prevented, and energy saving and comfortableness can be ensured.

((5) in FIG. 3)

If the current time has passed the presence-in-room start time (step S13; YES), the setting temperature Tset is changed to the target temperature Tm (step S14), and ordinary control is executed. Similarly, if the indoor temperature Tin reaches the target temperature Tm before the presence-in-room start time (step S12; YES), the setting temperature Tset is changed to the target temperature Tm (step S14), and ordinary control is executed as in the above case.

While (3) in FIG. 3 illustrates the example in which the temperature difference between the indoor temperature Tin and the setting temperature Tset is always maintained at α, it is also possible to seek a temperature difference αmin between the indoor temperature Tin and the setting temperature Tset at which the compressor 26 is stopped, to store the temperature difference αmin in the HEMS controller 12, for example, and to execute control such that the temperature difference is held in the range of αmin to α after the startup of the compressor. The temperature difference αmin can be sought by detecting an operation state of the compressor 26 while the setting temperature Tset is changed in units of a predetermined value, and by detecting a temperature difference between the indoor temperature Tin and the setting temperature Tset at the time when the state of the compressor 26 is changed from operation to non-operation. The determination as to whether the state of the compressor 26 is changed from operation to non-operation may be made by detecting the power consumption of the air-conditioning apparatus 1. (In general, the temperature difference α at which the compressor is started up and the temperature difference αmin at which the compressor is stopped are different from each other such that the startup and the stop of the compressor 26 will not be repeated frequently.)

In the case where αmin is 0 degrees C. and α is −1 degree C., for example, when the setting temperature Tset is set to 29 degrees C. at the indoor temperature Tin being 30 degrees C., the compressor is operated, causing the indoor temperature Tin to start lowering. When the indoor space is cooled until the temperature difference reaches −0.2 degrees C. (i.e., the indoor temperature Tin reaches 29.2 degrees C.), the setting temperature Tset is changed to 28.7 degrees C. (temperature difference is −0.5 degrees C.). Then, when the indoor space is cooled until the temperature difference reaches −0.2 degrees C. again (i.e., the indoor temperature Tin reaches 28.9 degrees C.), the above-described operation is repeated. Namely, the setting temperature Tset is changed to 28.4 degrees C. (temperature difference is −0.5 degrees C.).

If the setting temperature Tset is changed at intervals of several minutes in units of Δt in situations where αmin is unknown, there is a possibility of the operation coming into such a state that the compressor 26 may be stopped because the temperature difference between the indoor temperature Tin and the setting temperature Tset is reduced during the lapse of the time Δt, and that the compressor 26 may be started up again when the setting temperature Tset is changed to Tin+α. If the compressor 26 comes into the operation state of repeating the startup and the stop, the coolant in the air-conditioning apparatus 1 cannot be sufficiently circulated at the startup of the compressor 26, whereby the cooling capacity or the heating capacity is reduced and the operation efficiency is degraded (called a startup-stop repetition loss).

(Method of Determining Setting Temperature)

The method of determining the setting temperature may be executed in different ways between at the startup and after the startup in the precooling control or the preheating control. When the compressor in the cooling mode is started up at the temperature difference α between the setting temperature Tset and the indoor temperature Tin being −1 degree C. or less and is stopped at the temperature difference a being more than 0 degrees C., the setting temperature is controlled such that the temperature difference α is held at −1 degree C. or less at the startup of the precooling control and is held at 0 degrees C. or less after the startup of the precooling control. For example, when the indoor temperature Tin is constant at 25.2 degrees C., the setting temperature Tset is controlled to be set to 24.2 degree C. or lower at the startup of the precooling control, and set to 25.2 degrees C. (i.e., the indoor temperature) or lower after the startup of the precooling control. When the compressor in the heating mode is started up at the temperature difference α between the setting temperature Tset and the indoor temperature Tin being 1 degree C. or more and is stopped at the temperature difference α being less than 0 degrees C., the setting temperature is controlled such that the temperature difference α is held at 1 degree C. or more at the startup of the preheating control and is held at 0 degrees C. or more after the startup of the preheating control. For example, when the indoor temperature Tin is constant at 25.2 degrees C., the setting temperature Tset is controlled to be set to 26.2 degrees C. or higher at the startup of the preheating control and to 25.2 degrees C. or higher after the startup of the preheating control.

(Advantageous Effects)

Since the temperature difference between the setting temperature and the indoor temperature is determined while confirming the operation of the compressor, the startup-stop repetition loss of the air-conditioning apparatus can be prevented. For example, if the temperature difference between the setting temperature and the indoor temperature is set too small, the compressor may be stopped in some cases. If the compressor comes into the operation state of repeating the startup and the stop, the coolant in the air-conditioning apparatus cannot be sufficiently circulated at the startup of the compressor, whereby the cooling capacity or the heating capacity is reduced and the operation efficiency is degraded. Since the temperature difference is determined in such a manner as allowing the compressor 26 to sustain the operation capacity at an appropriately low level, the operation can be performed with high efficiency.

When the precooling control is incorporated in the measurement control device 30*a* for the outdoor unit or the measurement control device 30*b* for the indoor unit in the stage of design of the air-conditioning apparatus 1, the above-mentioned temperature differences α and αmin are known. Accordingly, the control flow for seeking the temperature differences α and αmin may be omitted, and the control may be executed by previously storing α and αmin in the measurement control device 30*a* or 30*b*, and by reading respective values of those parameters in the precooling or preheating control.

[Acquisition of Presence-in-Room Start Time]

(Step S1 in FIG. 4)

The user of the air-conditioning apparatus 1 previously sets presence-in-room information regarding the indoor space A, including the presence-in-room start time. The presence-in-room information contains, for example, a time at which the user starts to stay in the room, a time span during which the user continues staying in the room, and a time at which the user leaves the room. The presence-in-room information may be input or stored from any of the measurement control device 30*a* for the outdoor unit, the measurement control device 30*b* for the indoor unit, the remote controller 32, the HEMS controller 12, and the personal computer 2.

In the actual use of the air-conditioning apparatus 1, however, it is supposed that the presence-in-room information is different per day. Accordingly, the presence-in-room information may be estimated and set by employing the past information of a device (e.g., the remote controller 32), which is present in the indoor space A. One example of conceivable methods includes the steps of storing, in each of time zones including the morning, the noontime, the evening, and the night, a time at which the user first operates the air-conditioning apparatus through the remote controller 32, for example, collecting that information day by day, and estimating and setting the presence-in-room start time based on the collected information. When the presence-in-room start information is obtained in many values, the presence-in-room start time may be determined from an average value, for example.

Instead of practicing presence-in-room detecting means by collecting operation history of the remote controller 32, as described above, the presence of the user in the room may be detected by collecting usage information of the personal computer 2, the IH cooking heater 3, the range grill 4, the lighting apparatus 5, a TV (not illustrated), etc., which are disposed in the indoor space A, with the HEMS controller.

Alternatively, the presence of the user in the room may be detected by analyzing the power consumption measured by the power meter 9.

Moreover, the presence of the user in the room may be detected by employing human-presence sensing information obtained with a human presence sensor using infrared rays, for example, which is disposed on the air-conditioning apparatus 1 or another appliance, or by employing opening/closing information of a room door (not illustrated), which is equipped in the indoor space A.

[Determination of Precooling Start Time]

(Step S3 in FIG. 4)

The air-conditioning apparatus 1 determines the precooling start time of the air-conditioning apparatus 1 based on the information of the presence-in-room start time. The precooling start time is determined as a time earlier than the presence-in-room start time by a predetermined time.

Taking into account the fact that a time required to lower the indoor temperature is in proportion to a temperature difference between the indoor temperature at the precooling start time of the air-conditioning apparatus 1 and the target temperature Tm, an operation time required to lower temperature by 1 degree C. (hereinafter referred to simply as an "operation time T") is previously determined in accordance with the operation characteristics of the air-conditioning apparatus 1. Then, the precooling start time of the air-conditioning apparatus 1 is determined as a time earlier than the presence-in-room start time by a time that corresponds to the product resulting from multiplying the temperature difference between the indoor temperature at the precooling start time and the target temperature Tm by the operation time T.

The method of obtaining the presence-in-room start time, the method of determining the precooling start time, the values of α and β, etc. may be downloaded to the HEMS controller 12, for example, from the outside through the public line 14 and the communication unit 13.

The air-conditioning apparatus 1 can provide the following advantageous effects with the features of seeking a minimum temperature difference between the indoor temperature and the setting temperature, which is needed for the compressor to perform operation, and controlling the setting temperature to be set to have a predetermined temperature difference relative to the indoor temperature during the precooling or preheating control before the user stays in the room.

During the precooling operation of the air-conditioning apparatus 1, the temperature difference between the setting temperature and the indoor temperature is controlled to be held small such that the compressor 26 is operated with the operation capacity set to an appropriately low level. Therefore, highly efficient operation can be realized. If the air-conditioning apparatus 1 starts the ordinary operation without the precooling operation at the same time as when the user starts to stay in the room, the temperature difference between the indoor temperature and the target temperature set by the user is large, and the operation capacity of the compressor 26 is increased because the compressor is operated to compensate for the large temperature difference as soon as possible. Thus, lowering of the indoor temperature is expedited, and uncomfortable feeling of the user can be minimized. However, the efficiency is reduced due to an increase of the operation capacity of the compressor, and the power consumption of the air-conditioning apparatus 1 is increased. To avoid the above-described operation, in the air-conditioning apparatus 1, the operation capacity of the compressor 26 in the air-conditioning apparatus 1 is held at a medium level or below in the precooling operation during which the user does not stay in the room. As a result, the operation efficiency of the air-conditioning apparatus 1 can be increased, and an energy-saving operation with less power consumption can be realized.

Since the temperature difference between the setting temperature and the indoor temperature is determined while confirming the operation of the compressor, the startup-stop repetition loss of the air-conditioning apparatus can be prevented. For example, if the temperature difference between the setting temperature and the indoor temperature is set too small, the compressor may be stopped in some cases. If the compressor comes into the operation state of repeating the startup and the stop, the coolant in the air-conditioning apparatus cannot be sufficiently circulated at the startup of the compressor, whereby the cooling capacity or the heating capacity is reduced and the operation efficiency is degraded. Since the temperature difference is determined in such a manner as allowing the compressor 26 to sustain the operation capacity at an appropriately low level, the operation can be performed with high efficiency.

When the frequency of the compressor is commanded through calculation as in the related-art preliminary operation, an adjustment is necessary to cope with different coefficients depending on different types of air-conditioning apparatuses, and it is difficult to execute the precooling control for a variety of air-conditioning apparatuses. In contrast, according to Embodiment 1, since the operation capacity of the compressor can be readily suppressed with the adjustment of the setting temperature, the control can be executed more easily, and the precooling control can be applied to various types of air-conditioning apparatuses.

Since the cooling or heating operation is already started at the presence-in-room time, comfortableness is improved when the user enters the room.

Since the indoor temperature can be more easily managed by commanding the setting temperature than in the case of commanding the frequency of the compressor, comfortableness during the precooling is also improved.

In the HEMS, a peak of power consumption of the entire house can be reduced and the power consumption can be leveled by performing the precooling or preheating operation of the air-conditioning apparatus except for a time zone in which other home electrical appliances are used very often. Accordingly, power saving can be realized with social contribution to compensating for deficiency of electric power. Also when electricity of solar power generation or a battery installed in the house is supplied to the home electrical appliances, electric power is leveled and the electricity can be utilized with high efficiency.

When the air-conditioning apparatus is controlled from an external controller such as the HEMS controller, a process of sending a command is easier to execute insofar as the command is an item, for example, change of the setting temperature, which is operable from the remote controller. Hence, application to existing air-conditioning apparatuses can be facilitated.

There are recommended standard interface specifications, such as ECHONET Lite, aiming that, when an air-conditioning apparatus is controlled from an external controller such as a HEMS controller, manipulations of stopping the operation and changing the operation mode and the setting temperature, for example, can be performed in common for various types of air-conditioning apparatuses regardless of the maker. In that standard interface, the setting temperature is changed in units of 1 degree C. Therefore, assuming that the setting temperature Tset in the precooling control is a maximum integer value among allowable values, the setting temperature Tset at the startup of the precooling control is 24 degrees C., and the setting temperature Tset after the startup of the precooling control is 25 degrees C. in the above-described example. Assuming that the setting temperature Tset in the preheating control is a minimum integer value among allowable values, the setting temperature Tset at the startup of the preheating control is 27 degrees C., and the setting temperature Tset after the startup of the preheating control is 26 degrees C. in the above-described example.

(Advantageous Effects)

By converting the setting temperature Tset to an integer value, when an air-conditioning apparatus is controlled from an external controller such as a HEMS controller, a command can be communicated in accordance with the standard interface specifications. Accordingly, the precooling control or the preheating control can be applied regardless of the maker of the air-conditioning apparatus, and versatility can be increased.

While Embodiment 1 illustrates, by way of example, the case of employing, as the indoor temperature for use in the air-conditioning apparatus 1, the temperature in the indoor space A to be air-conditioned, that is, the temperature measured by the indoor temperature sensor 31, embodiments are not limited to the illustrated one. The indoor temperature used in the air-conditioning apparatus 1 may be given as the temperature of a structural member in the indoor space A, which is measured by the structural-member temperature detector 33 for sensing a radiation temperature, such as an infrared sensor disposed in the air-conditioning apparatus 1, for example. Using the temperature of the structural member as the indoor temperature for use in the air-conditioning apparatus 1 provides the following advantages.

During the precooling operation, a heat load required to cool the structural member in the indoor space A down to the setting temperature is larger than that attributable to intrusion of heat from the outside. Therefore, it is important to determine whether an amount of heat generated from the structural member is treated properly, from the viewpoint of satisfactorily realizing the precooling operation. In the case using the temperature of the indoor air as a determination criterion, because the indoor air has a smaller heat capacity than the structural member, response of the air-conditioning operation appears at earlier timing. This may result in a possibility of determining that the indoor space A has been sufficiently cooled, in spite of the structural member being still at a higher temperature. If the presence-in-room start time is reached and the setting temperature is changed to the target temperature in such a state, the indoor temperature is not lowered as intended because the structural member is still at a higher temperature. Correspondingly, the operation capacity of the air-conditioning apparatus 1 is increased and the operation efficiency of the air-conditioning apparatus 1 is degraded. In addition, there is a possibility that the state of the indoor temperature being relatively high may last for a longer time, and comfortableness may also be degraded. By performing the precooling operation such that the temperature of the structural member becomes the setting value of the indoor temperature, it is possible to avoid the state where the indoor temperature remains relatively high even after the presence-in-room start time, and to realize the operation while energy saving and comfortableness are kept at a high level.

While Embodiment 1 has been described above in connection with the precooling operation in the cooling mode, the preheating operation in the heating mode can also be performed in a similar manner. In the heating operation, the formula used in step S6 of FIG. 4 for determining the setting temperature is changed to Tin+α>Tm, and if Tin+α is not higher than the target temperature Tm (step S6; NO), the setting temperature Tset is changed to Tin+α (step S8).

(When User Does not Come Back to Home)

When the presence of the user in the room (i.e., coming-back to home) is not detected even after the lapse of a predetermined time from the start of operation of the precooling control or the preheating control, the setting temperature Tset may be changed, or the operation may be stopped. The presence of the user in the room may be detected in accordance with input operation of the remote controller 32, or may be detected by collecting usage information of the personal computer 2, the IH cooking heater 3, the range grill 4, the lighting apparatus 5, the TV (not illustrated), etc., which are disposed in the indoor space A, with the HEMS controller. Alternatively, the presence of the user in the room may be detected by analyzing the power consumption measured by the power meter 9. Moreover, the presence of the user in the room may be detected by employing human-presence sensing information obtained with a human presence sensor using infrared rays, for example, which is disposed on the air-conditioning apparatus 1 or another appliance, or by employing opening/closing information of a door or a window (not illustrated), which is equipped in the indoor space A. The presence of the user in the room may be determined in accordance with information (on/off of Wi-Fi connection or GPS-based position information) obtained from a position detector 41 in a communication device 40, such as a cellular phone, a smartphone, a personal computer, or a car navigator possessed by the user. A camera of an interphone (not illustrated) may also be used to detect the presence of the user in the room (i.e., coming-back to home).

The setting temperature Tset set when the user is not yet present in the room even after the lapse of the predetermined time may be fixedly set to a particular temperature. Alternatively, when the cooling or the heating is to be performed in accordance with a relative value to the original target temperature, the setting temperature may be set, for example, higher by 2 degrees C. in the case of the cooling, and lower by 2 degrees C. in the case of the heating.

(Advantageous Effects)

When the presence of the user in the room (i.e., coming-back to home) is not detected even after the lapse of the predetermined time from the start of operation of the precooling control or the preheating control, the setting temperature Tset is changed, or the operation is stopped. Accordingly, even when the coming-back of the user to home is delayed from the scheduled time due to urgent business, wasteful operation during the period in which the user is not present in the room can be avoided, and the power consumption can be reduced.

When the precooling or preheating control operation of the air-conditioning apparatus 1 is performed, a current limitation value may be set in several divided stages. Furthermore, a current limitation value may be defined when a power saving mode is set in the air-conditioning apparatus 1 or the HEMS controller 12. Of the power consumption of the air-conditioning apparatus 1, the compressor 26 occupies about 80 to 90%, the indoor fan 25*a* occupies about 5 to 10%, and the outdoor fan 27*a* occupies about 5 to 10%. Accordingly, when limiting a current in the air-conditioning apparatus 1, it is required to lower the frequency of the compressor 26, thus reducing the operation capacity, and to lower the rotation speed of the indoor fan 25*a* or the outdoor fan 27*a*, thus reducing the air volume. The current limitation value may be expressed in terms of a relative value (%), for example, a current limitation value of 70% on condition that it is 100% where there is no current limitation, or in terms of a specific absolute value, for example, a current limitation value of 3 A (ampere).

In the case where the power saving mode is set in the air-conditioning apparatus 1 or the HEMS controller 12, when the current limitation value is 70%, for example, an upper limit frequency of the compressor 26 is limited to 70% of a maximum frequency thereof, and the rotation speed of each of the indoor fan 25*a* and the outdoor fan 27*a* is limited to 70% of a maximum rotation speed thereof. When the current limitation value is 3 A on condition that an operation current without any limitations is 5 A, the upper limit frequency of the compressor 26 is limited to ⅗ of the maximum frequency thereof, and the rotation speed of each of the indoor fan 25*a* and the outdoor fan 27*a* is limited to ⅗ of the maximum rotation speed thereof. In general, the operation current without any limitations is specifically indicated for each air-conditioning apparatus.

While, in the above description, a reference (100%) without any current limitations is set as a maximum value of the frequency of the compressor or a maximum value of the rotation speed of the fan, embodiments are not limited to the described one, and limitation may be set by employing, as a reference, a frequency of the compressor or a rotation speed of the fan in the ordinary operation. For example, when the frequency of the compressor is to be 50 Hz in the ordinary control without any current limitations, the frequency of the compressor is set to 35 Hz on condition that the current limitation value is 70%. Furthermore, when the rotation speed of the indoor fan in strong-wind setting is to be 1000 rpm in the ordinary control without any current limitations, the rotation speed of the indoor fan is set to 700 rpm on condition that the current limitation value is 70%.

When the current limitation value is set in the precooling control or the preheating control, the frequency of the compressor 26 and the rotation speed of each of the indoor fan 25*a* and the outdoor fan 27*a* may be limited as in the above-described case, or the method of controlling the setting temperature Tset may be changed. In an example of changing the method of controlling the setting temperature Tset, when the compressor in the cooling mode is started up at the temperature difference α between the setting temperature Tset and the indoor temperature Tin being −1 degree C. or less, and is stopped at the temperature difference α being more than 0 degrees C., the setting temperature is controlled such that the temperature difference α is held in the range of −0.7 degrees C. to 0 degrees C. after the startup of the compressor, on condition that the current limitation value is 70% in the precooling control.

(Advantageous Effects)

The precooling control and the preheating control may cause anxiety because the user is not present in the room and cannot confirm the state of the air-conditioning apparatus. However, safety and energy saving are increased by setting the current limitation value.

When the precooling or preheating control operation of the air-conditioning apparatus 1 is performed, the range from an upper limit to a lower limit of the setting temperature Tset may be restricted to be narrower than the operable range of the remote controller 32. Furthermore, when the power saving mode is set in the air-conditioning apparatus 1 or the HEMS controller 12, the range from an upper limit to a lower limit of the setting temperature Tset may be restricted to be narrower than the operable range of the remote controller 32. When the precooling or preheating control operation of the air-conditioning apparatus 1 is performed, there is a risk that, if a person who cannot manipulate the remote controller, for example, a person during sleep or an infant child, is present an air-conditioned area, the person's health may be adversely affected due to hotness or coldness. Such a risk can be avoided by setting the range of the setting temperature to be narrower than the operable range of the remote controller. In the case of cooling, for example, the range of the setting temperature settable through the operation of the communication device 40 is limited to 25 to 28 degrees C. even though the range of 20 to 30 degrees C. can be selected as the setting temperature by the remote controller. In the case of heating, the range of the setting temperature settable through the operation of the communication device 40 is limited to 19 to 22 degrees C. even though the range of 15 to 25 degrees C. can be selected as the setting temperature by the remote controller.

(Advantageous Effects)

Safety and energy saving are increased by restricting the range from an upper limit to a lower limit of the setting temperature Tset to be narrower than the allowable operation range of the air-conditioning apparatus 1 (i.e., the operable range of the remote controller 32).

A system may be designed so as to send a notice for notifying the start of the operation to the user, or to obtain permission for the operation from the user when the precooling or preheating control operation of the air-conditioning apparatus 1 is started. For example, when the precooling control start time is reached (step S4 in FIG. 4; YES), a mail is sent from a measurement control device, such as the HEMS controller 12, to the communication device 40, such as a cellular phone, a smartphone, a personal computer, or a car navigator possessed by the user, through the communication unit 13 and the public line 14, thus notifying the start of the operation. Alternatively, the user may be prompted to push a button for permitting the start of the operation through the communication device 40.

(Advantageous Effects)

The precooling control and the preheating control may cause anxiety because the user is not present in the room and cannot confirm the state of the air-conditioning apparatus. However, safety is increased by providing a means for confirming the operation prior to the start of the operation. Furthermore, when the time of coming back to home is changed from the routine time, the start of the operation can be avoided, and wasteful power consumption can be prevented, thus increasing an energy-saving effect.

Embodiment 2.

(Remote Control)

An example in which the precooling control or the preheating control is executed from the communication device will be described below. The same points as those in Embodiment 1 are not described here.

Referring to FIG. 1, the user possesses a communication device 40, such as a cellular phone, a smartphone, a personal computer, or a car navigator. When the user being present indoor or outdoor sends data from the communication device 40 through the public line 14, the data is received by and the communication unit 13 and is transferred to the HEMS controller 12. As the occasion requires, data is replied from the HEMS controller 12 and is returned to the communication device 40 through the communication unit 13. Accordingly, as in the case of directly manipulating the HEMS controller 12 by the user's hand, information in the HEMS can be remotely obtained, or an operation command can be remotely issued to the HEMS. Thus, the communication device 40, such as a cellular phone, a smartphone, a personal computer, or a car navigator, can send an operation command to the home electrical appliances 1 to 5, can receive operation information of the home electrical appliances 1 to 5, and can receive power information from the power conditioner 8 and the power meter 9. From a screen of the smartphone, for example, the user can issue commands of instructing startup or stop of the operation of the air-conditioning apparatus 1, selecting the operation mode, such as cooling, heating, air-sending or dehumidifying, and changing the setting temperature, the air volume, and the air direction, as in the case of manipulating the remote controller 32.

(Advantageous Effects)

Since the air-conditioning apparatus 1 can be remotely operated from the communication device 40, the operation can be started before the user comes back to home, and the room can be held in a state air-conditioned to a comfortable temperature when the user comes back to home. Therefore, comfortableness is improved. Even when the time of coming back to home is different day by day, the operation can be started at an appropriate time, and convenience is improved in comparison with case of programming the operation in advance through the remote controller at home. Moreover, wasteful operation during a period in which the user is not present at home can be avoided, and the power consumption can be reduced. In addition, when a person who is unfamiliar to the operation of the air-conditioning apparatus 1 is present at home, or when the user is going out while a pet is left at home, indoor environment can be managed through remote control, and convenience is improved.

On a screen of the cellular phone, the user can not only confirm the state of the air-conditioning apparatus 1 (e.g., startup or stop of the operation, the operation mode such as cooling, heating, air-sending or dehumidifying, the setting temperature, the air volume, and the air direction), but also display and see air-conditioning information, such as the temperature of sucked air (indoor temperature), the indoor humidity, and the outdoor temperature, which are measured in the air-conditioning apparatus 1. For example, when it is confirmed upon looking at the state of the air-conditioning apparatus 1 that the air-conditioning apparatus 1 is already operated, the user can make decision not to perform the remote operation because another family member has already operated the air-conditioning apparatus 1. When the indoor temperature exceeds 30 degrees C. upon looking at the air-conditioning information, the user can make decision to remotely turn on the cooling operation.

(Advantageous Effects)

Since the state of the air-conditioning apparatus 1 and the air-conditioning information can be viewed through the communication device 40, such information can be utilized as criteria for remotely determining whether the operation is to be started, and convenience is improved.

When the air-conditioning apparatus 1 is operated from the communication device 40, a current limitation value may be set. Furthermore, a current limitation value may be set when the power saving mode is set in the air-conditioning apparatus 1 or the HEMS controller 12. Of the power consumption of the air-conditioning apparatus 1, the compressor 26 occupies about 80 to 90%, the indoor fan 25*a* occupies about 5 to 10%, and the outdoor fan 27*a* occupies about 5 to 10%. Accordingly, when limiting a current in the air-conditioning apparatus 1, it is required to lower the frequency of the compressor 26, thus reducing the operation capacity, and to lower the rotation speed of the indoor fan 25*a* or the outdoor fan 27*a*, thus reducing the air volume. The current limitation value may be expressed in terms of a relative value (%), for example, a current limitation value of 70% on condition that it is 100% where there is no current limitation, or in terms of a specific absolute value, for example, a current limitation value of 3 A (ampere).

In the case where the power saving mode is set in the air-conditioning apparatus 1 or the HEMS controller 12, when the current limitation value is 70%, for example, an upper limit frequency of the compressor 26 is limited to 70% of a maximum frequency thereof, and the rotation speed of each of the indoor fan 25*a* and the outdoor fan 27*a* is limited to 70% of a maximum rotation speed thereof. When the current limitation value is 3 A on condition that an operation current without any limitations is 5 A, the upper limit frequency of the compressor 26 is limited to ⅗ of the maximum frequency thereof, and the rotation speed of each of the indoor fan 25*a* and the outdoor fan 27*a* is limited to ⅗ of the maximum rotation speed thereof. In general, the operation current without any limitations is specifically indicated for each air-conditioning apparatus.

While, in the above description, a reference (100%) without any current limitations is set as a maximum value of the frequency of the compressor or a maximum value of the rotation speed of the fan, embodiments are not limited to the described one, and limitation may be set by employing, as a reference, a frequency of the compressor or a rotation speed of the fan in the ordinary operation. For example, when the frequency of the compressor is to be 50 Hz in the ordinary control without any current limitations, the frequency of the compressor is set to 35 Hz on condition that the current limitation value is 70%. Furthermore, when the rotation speed of the indoor fan in strong-wind setting is to be 1000 rpm in the ordinary control without any current limitations, the rotation speed of the indoor fan is set to 700 rpm on condition that the current limitation value is 70%.

When the current limitation value is set in the precooling control or the preheating control, the frequency of the compressor 26 and the rotation speed of each of the indoor fan 25*a* and the outdoor fan 27*a* may be limited as in the above-described case, or the method of controlling the setting temperature Tset may be changed. In an example of changing the method of controlling the setting temperature Tset, when the compressor in the cooling mode is started up at the temperature difference $\alpha$ between the setting temperature Tset and the indoor temperature Tin being −1 degree C. or less, and is stopped at the temperature difference $\alpha$ being more than 0 degrees C., the setting temperature is controlled such that the temperature difference $\alpha$ is held in the range of −0.7 degrees C. to 0 degrees C. after the startup of the compressor, on condition that the current limitation value is 70% in the precooling control.

(Advantageous Effects)

Safety and energy saving are increased by setting the current limitation value.

When the air-conditioning apparatus 1 is operated from the communication device 40, the range from an upper limit to a lower limit of the setting temperature Tset may be restricted to be narrower than the operable range of the remote controller 32. Furthermore, when the power saving mode is set in the air-conditioning apparatus 1 or the HEMS controller 12, the range from an upper limit to a lower limit of the setting temperature Tset may be restricted to be narrower than the operable range of the remote controller 32. When the air-conditioning apparatus 1 is operated from the communication device 40, there is a risk that, if a person who cannot manipulate the remote controller, for example, a person during sleep or an infant child, is present an air-conditioned area, the person's health may be adversely affected due to hotness or coldness. Such a risk can be avoided by setting the range of the setting temperature to be narrower than the operable range of the remote controller. In the case of cooling, for example, the range of the setting temperature settable through the operation of the communication device 40 is limited to 25 to 28 degrees C. even though the range of 20 to 30 degrees C. can be selected as the setting temperature by the remote controller. In the case of heating, the range of the setting temperature settable through the operation of the communication device 40 is limited to 19 to 22 degrees C. even though the range of 15 to 25 degrees C. can be selected as the setting temperature by the remote controller.

(Advantageous Effects)

Safety and energy saving are increased by restricting the range from an upper limit to a lower limit of the setting temperature Tset.

(Method of Selecting Air Conditioner)

When the HEMS includes more than one air-conditioning apparatus 1, it is required to select one of the air-conditioning apparatuses, which is a target to be operated, when an operation command is issued from the communication device 40, such as a cellular phone, a personal computer, or a car navigator. Software for issuing the operation command may be designed to present buttons or a selection screen for selecting one of the air-conditioning apparatuses such that, once any of the air-conditioning apparatuses is selected, the selected air-conditioning apparatus is stored and it is automatically selected as the target when the user is going to perform the operation next time. Alternatively, the air-conditioning apparatus as an operation target may be fixedly registered for each communication device 40 in advance. Information regarding combinations between the communication device 40 and the air-conditioning apparatuses may be stored in the HEMS controller or the communication device 40.

(Advantageous Effects)

When the HEMS includes more than one air-conditioning apparatuses 1, versatility is increased by making target one of the air-conditioning apparatuses freely selectable from the communication device 40. With the function of automatically determining, as the operation target, one from the plurality of air-conditioning apparatuses 1, there is no need of selecting the target air-conditioning apparatus whenever the user is going to perform the operation, and convenience is improved.

Life patterns of the user after coming back to home may be routinely stored in the HEMS controller, and the air-conditioning apparatus may be automatically selected depending on the life pattern when an operation command is issued from the communication device 40, such as a cellular phone, a personal computer, or a car navigator. The life patterns are classified, for example, into cooking, eating, watching a TV, taking a bath, sleeping, operating the personal computer, and reading a book. Air conditioners in a kitchen, a dining room, a living room, a bath room, a bed room, and a study room are optionally selected depending on one of those life patterns. When there are plural users, life patterns are stored for each user, and control is performed after specifying the user through identification of the communication device 40. When the HEMS controller is used to detect coming-back of the user to home, the coming-back may be determined in accordance with information (on/off of Wi-Fi connection or GPS-based position information) from the cellular phone, and the user may be specified through identification of the cellular phone. Alternatively, the user may be specified by recognizing the user's face with a camera of an interphone. After detection of the coming-back to home, information is routinely accumulated by analyzing life patterns from respective power consumptions of home electrical appliances and lighting apparatuses, or by analyzing life patterns from respective outputs of human presence sensors using infrared rays, ultrasonic waves, visible light, etc. The sensors using infrared rays, ultrasonic waves, visible light, etc. may be installed on the walls and the ceilings of a house, or may be incorporated in the air-conditioning apparatuses 1.

(Advantageous Effects)

When the HEMS includes more than one air-conditioning apparatuses 1 and one air-conditioning apparatus as the operation target is automatically determined from the plurality of air-conditioning apparatuses 1 depending on the life pattern after the user has come back to home, there is no need of selecting one of the air-conditioning apparatuses, and convenience is improved.

(Method of Determining Precooling Time)

When an operation command is issued from the communication device 40, such as a cellular phone, a smartphone, a personal computer, or a car navigator, the process, in step S1 of FIG. 4, of obtaining the presence-in-room start time may be omitted, and the precooling control may be started at once. In that case, the precooling start time determined in step S3 of FIG. 4 is automatically set as the time of receiving the operation command from the communication device 40, and the determination, in step S13 of FIG. 4, regarding whether the current time reaches the presence-in-room start time is omitted.

Alternatively, the precooling start time may be designated when the operation command is sent from the communication device 40, such as a cellular phone, a smartphone, a personal computer, or a car navigator.

Alternatively, the start of the precooling control may be determined by comparing GPS-based position information regarding a current position of the communication device 40 and position information of the home with each other. For example, if the current position is apart from the home by 30 km and an estimated arrival time is one hour later when the operation command is issued from the communication device 40 such as a car navigator or a cellular phone, the precooling control is not started (i.e., the cooling operation is not started) at once. When the distance from the current position to the homes falls within a predetermined distance, or when the estimated arrival time falls within a predetermined time, the precooling control is started. When an optimum precooling time automatically determined from the setting temperature of the air-conditioning apparatus 1, the temperature of the sucked air, and the outdoor temperature is 20 minutes, the precooling control is started upon the estimated arrival time reaching 20 minutes.

(Advantageous Effects)

Even when the time of coming back to home is different day by day, the operation can be started at an appropriate time, and convenience is improved in comparison with case of programming the operation in advance through the remote controller at home. Moreover, wasteful operation during a period in which the user is not present at home can be avoided, and the power consumption can be reduced. Since the start of the precooling control is automatically determined from the position information, convenience is further improved. In addition, it is ensured that the wasteful operation during the period in which the user is not present at home can be avoided, and the power consumption can be reduced.

(When User Does not Come Back to Home)

When the presence of the user in the room (i.e., coming-back to home) is not detected even after the lapse of a predetermined time from the start of operation of the precooling control or the preheating control, the setting temperature Tset may be changed, or the operation may be stopped. The presence of the user in the room may be determined in accordance with information (on/off of Wi-Fi connection or GPS-based position information) obtained from the communication device 40, or may be detected with a camera of an interphone (not illustrated). The presence of the user in the room may be detected in accordance with input operation of the remote controller 32, or may be detected by collecting usage information of the personal computer 2, the IH cooking heater 3, the range grill 4, the lighting apparatus 5, the TV (not illustrated), etc., which are disposed in the indoor space A, with the HEMS controller. Alternatively, the presence of the user in the room may be detected by analyzing the power consumption measured by the power meter 9. Moreover, the presence of the user in the room may be detected by employing human-presence sensing information obtained with a human presence sensor using infrared rays, for example, which is disposed on the air-conditioning apparatus 1 or another appliance, or by employing opening/closing information of a door or a window (not illustrated), which is equipped in the indoor space A.

The setting temperature Tset set when the user is not yet present in the room even after the lapse of the predetermined time may be fixedly set to a particular temperature. Alternatively, when the cooling or the heating is to be performed in accordance with a relative value to the original target temperature, the setting temperature may be set, for example, higher by 2 degrees C. in the case of the cooling, and lower by 2 degrees C. in the case of the heating.

(Advantageous Effects)

When the presence of the user in the room (i.e., coming-back to home) is not detected even after the lapse of the predetermined time from the start of operation of the precooling control or the preheating control, the setting temperature Tset is changed, or the operation is stopped. Accordingly, even when the coming-back of the user to home is delayed from the scheduled time due to urgent business, wasteful operation during the period in which the user is not present in the room can be avoided, and the power consumption can be reduced.

Programs executed in the above-embodiment embodiments may be distributed in form stored in a computer-readable recording medium, such as a flexible disk, a CD-ROM (Compact Disk Read-Only Memory), a DVD (Digital Versatile Disk), or an MO (Magneto-Optical Disk). A system for executing the above-described processing may be constituted by installing the distributed programs.

The programs may be stored in a disk device, for example, which is included in a predetermined server on a communication network, such as the Internet, and they may be downloaded, for example, in form superimposed on carrier waves.

When the above-described functions are practiced in a sharing manner with an OS (Operating System), or practiced with cooperation of the OS and an application, only the functions other than shared by the OS may be distributed in form stored in a medium, or may be downloaded, for example, for distribution.

It is to be noted that the present invention is not limited by the above-described embodiments and drawings. As a matter of course, the above-described embodiments and drawings may be changed within a scope not changing the gist of the present invention.

INDUSTRIAL APPLICABILITY

The present invention is suitable for an air-conditioning system in which cooling or heating is performed prior to the presence-in-room time.

The invention claimed is:

1. An air-conditioning apparatus executing a precooling operation or a preheating operation such that an indoor temperature representing a current temperature inside a building containing the air-conditioning apparatus reaches a target temperature, the air-conditioning apparatus comprising:

a refrigeration cycle including a compressor;

a controller configured to control the refrigeration cycle including the compressor; and a temperature sensor configured to detect the indoor temperature, wherein the controller is configured to control a setting temperature of the air-conditioning apparatus during execution of the precooling operation or the preheating operation such that a first temperature difference between the indoor temperature, as detected by the temperature sensor, and the setting temperature is not less than a threshold temperature difference above which the compressor performs operation, determine a second temperature difference between the indoor temperature, as detected by the temperature sensor, and the target temperature, and change the setting temperature to the target temperature when the determined second temperature difference is less than the first temperature difference.

2. The air-conditioning apparatus of claim 1, wherein the controller is further configured to estimate a presence-in-room start time, and start the precooling operation or the preheating operation prior to the presence-in-room start time by a predetermined time, wherein the precooling operation or the preheating operation are performed such that the target temperature is reached by at least the presence-in-room start time.

3. The air-conditioning apparatus of claim 2, wherein the presence-in-room start time is estimated from input information received from an input device of the air-conditioning apparatus.

4. The air-conditioning apparatus of claim 2, further comprising a presence-in-room detector that recognizes a presence of a user in a room, wherein the presence-in-room start time is estimated from past record information of the presence-in-room detector.

5. The air-conditioning apparatus of claim 1, further comprising a receptor that receives an operation control instruction that instructs start of the precooling operation or the preheating operation.

6. The air-conditioning apparatus of claim 1, further comprising structural-member temperature detector that detects a temperature of a structural member present indoors, wherein the indoor temperature is determined from the temperature of the structural member, which is detected by the structural-member temperature detector.

7. The air-conditioning apparatus of claim 1, wherein the controller is further configured to set the threshold temperature difference at which the compressor performs operation to a minimum temperature difference at which the compressor performs operation.

8. The air-conditioning apparatus of claim 1, wherein the controller is further configured to detect an operation state of the compressor, while the setting temperature is changed, to determine a third temperature difference between the indoor temperature and the setting temperature when the state of the compressor is changed from non-operation to operation, detect an operation state of the compressor, while the setting temperature is changed, to determine a fourth temperature difference between the indoor temperature and the setting temperature when the state of the compressor is changed from operation to non-operation, and set the threshold temperature difference at which the compressor performs operation into a range from the third temperature difference to the fourth temperature difference.

9. An air-conditioning system comprising:

an air-conditioning apparatus executing a precooling operation or a preheating operation such that an indoor temperature representing a current temperature inside a building containing the air-conditioning apparatus reaches a target temperature by using a refrigeration cycle including a compressor;

a controller configured to control the air-conditioning apparatus;

a temperature sensor configured to detect the indoor temperature; and a receptor configured to receive an operation control instruction from outside of the building, wherein the controller is configured to control a setting temperature of the air-conditioning apparatus during execution of the precooling operation or the preheating operation such that a first temperature difference between the indoor temperature, as detected by the temperature sensor, and the setting temperature is not less than a threshold temperature difference above which the compressor performs operation, measure a second temperature difference between the indoor temperature, as detected by the temperature sensor, and the target temperature, and change the setting temperature to the target temperature when the measured second temperature difference is less than the first temperature difference.

10. The air-conditioning apparatus of claim 8, wherein the controller is further configured to at a startup time of the precooling operation or the preheating operation, set the setting temperature such that the first temperature difference is not less than the third temperature difference, and after the startup time of the precooling operation or the preheating operation, set the setting temperature such that the first temperature difference is not less than the fourth temperature difference.

11. The air-conditioning system of claim 9, wherein the controller is further configured to at a startup time of the precooling operation or the preheating operation, determine the setting temperature such that the first temperature difference is not less than the fifth temperature difference, and after the startup time of the precooling operation or the preheating operation, determine the setting temperature such that the first temperature difference is not less than the sixth temperature difference.

12. The air-conditioning system of claim 9, wherein the controller is further configured to determine the setting temperature in the precooling operation to a maximum integer value among allowable values, and determine the setting temperature in the preheating operation to a minimum integer value among allowable values.

13. The air-conditioning apparatus of claim 1, wherein the controller is further configured to determine a current limitation value indicating a limit on the current used by elements of the air-conditioning system.

14. The air-conditioning apparatus of claim 1, wherein the controller is further configured to determine the setting temperature into a range from an upper limit value to a lower limit value, the range being narrower than a settable range of the precooling operation or the preheating operation.

15. The air-conditioning apparatus of claim 2, further comprising presence-in-room detector that recognizes presence of a user of the air-conditioning apparatus in a room, wherein the controller is further configured to, when the presence of the user in the room is not detected even after lapse of a predetermined time from startup of the precooling operation or the preheating operation, change the setting temperature or stop the air-conditioning apparatus.

16. The air-conditioning apparatus of claim 15, wherein the presence-in-room detector collects at least one of operation history of an air-conditioning remote controller, usage information of a lighting apparatus and home electrical appliances, information of power consumption in a home, information of a human presence sensor opening/closing information of a room door, communication information of a communication device, and position information.

17. The air-conditioning system of claim 9, further comprising a plurality of air-conditioning apparatuses including the air-conditioning apparatus, wherein the controller is further configured to select one air-conditioning apparatus automatically from the plurality of air-conditioning apparatuses as an operation target based on at least one of operation history and life pattern information of a user of the air-conditioning system, the operation target being a one of the plurality of air-conditioning apparatuses selected to perform a precooling or preheating operation.

18. The air-conditioning system of claim 9, further comprising a power meter configured to measure power consumption of the air-conditioning system, wherein the controller is further configured to determine the power consumption of the air-conditioning system, while the setting temperature is changed, to determine a fifth temperature difference between the indoor temperature and the setting temperature when the power consumption is not less than first power consumption that is given as the power consumption when a state of the compressor is changed from non-operation to operation, determine the power consumption of the air-conditioning system, while the setting temperature is changed, to determine a sixth temperature difference between the indoor temperature and the setting temperature when the power consumption is not more than a second power consumption that is given as the power consumption when the state of the compressor is changed from operation to non-operation, and set the threshold temperature difference at which the compressor performs operation into a range from the fifth temperature difference to the sixth temperature difference.

19. An air-conditioning system of claim 9, further comprising a communication device that instructs start of the precooling operation or the preheating operation.

20. The air-conditioning system of claim 19, wherein the communication device includes a position detector, and the controller is further configured to determine whether the precooling operation or the preheating operation is to be started, by employing position information obtained with the position detector.

* * * * *